United States Patent [19]

Stagg

[11] Patent Number: 4,940,246

[45] Date of Patent: Jul. 10, 1990

[54] ARROW ATTACHMENT

[76] Inventor: Jonathan B. Stagg, 4213 E. 28 Rd., Cadillac, Mich. 49601

[21] Appl. No.: 393,882

[22] Filed: Aug. 14, 1989

[51] Int. Cl.[5] ..... F42B 6/08

[52] U.S. Cl. ..... 273/421

[58] Field of Search ..... 273/416, 419–422

[56] References Cited

U.S. PATENT DOCUMENTS

| | | | |
|---|---|---|---|
| 2,568,417 | 9/1951 | Steinbacher | 273/421 |
| 2,859,970 | 11/1958 | Doonan | 273/421 |
| 4,099,720 | 7/1978 | Zeren | 273/422 |
| 4,166,619 | 9/1979 | Bergmann et al. | 273/421 X |
| 4,268,038 | 5/1981 | Wierenga | 273/416 |
| 4,380,340 | 4/1983 | Simo | 273/416 |
| 4,452,460 | 6/1984 | Adams | 273/422 |

*Primary Examiner*—Paul E. Shapiro

*Attorney, Agent, or Firm*—Learman & McCulloch

[57] ABSTRACT

An arrow attachment for inducing hemorrhaging in a big game target has at least one cutting blade movable from a retracted, inoperative position to a projected operative cutting position, the blade being provided with an actuating member which projects outwardly relative to the blade and which, upon being subjected to an impact resistance, functions to move the cutting blade from the retracted position toward the projected position.

7 Claims, 2 Drawing Sheets

ARROW ATTACHMENT

This invention relates to an arrow attachment which includes a movable cutting blade designed for inducing hemorrhaging in a big game target when such blade is moved to a projected position from a normally retracted position in the body portion of the attachment, such attachment including means for effecting such movement of the cutting blade in response to target penetration.

BACKGROUND OF THE INVENTION

Efforts have been made to provide improved designs of bow-hunting arrows capable of producing more certain and quicker big game kills. Primarily, such efforts have been directed to the provision of various types of barbs which function to retain the arrow in the target so as to produce continuous bleeding and thereby shorten the length of tracking and kill time.

Fixed barbs, while effective for arrow retention, limit the depth of the wound. It has been suggested that various forms of retractable barbs may be useful in overcoming this particular problem. For example, arrow attachments have been devised which utilize spring-biased barbs initially held in a retracted position against the spring bias and adapted to be released upon impact with the big game target. Such devices are often of rather complex and expensive design, particularly with respect to the barb retention means responsible for holding the barbs in the inoperative position until impact.

Additionally, considerable attention has been given to the problem of withdrawing a barbed arrow without inducing unnecessary damage to surrounding meat areas. Thus, some designs include adjustable shaft mechanisms which may be worked externally of the game to retract the barbs exposed within the impacted areas. With such mechanisms the cost of manufacture and the resulting cost of the product may increase substantially.

In most cases, blood loss, rather than shock, is the primary cause of death of a game animal shot with an arrow. While barbs are intended to promote continuous bleeding, they cannot be relied upon to increase bleeding. It is recognized that in order to produce fast and clean kills from well-placed shots, substantial hemorrhaging is desirable. Thus, in the absence of any reliable means for increasing hemorrhaging, ill-placed shots are even more undesirable as they are more apt to result in painful injury to game animals and, in many instances, be the cause of either a painful recovery or unduly slow death.

The use of barbs of the type described is incapable of reliably overcoming the two strongest arguments against big game hunting, namely, painful protracted injury or painful slow death.

SUMMARY OF THE INVENTION

The invention comprises an attachment particularly adapted for use in an arrow of the type used in big game hunting. The attachment includes a body which may be fitted to an arrow shaft either just rearwardly of the arrow head, or the attachment actually may carry the arrowhead. A pair of cutting blades is pivotally mounted on the body for movement from a retracted storage position to an outwardly projected position by means of an actuating member or finger which forms a part of each blade and which functions to effect such movement of the blade in response to penetration of the arrowhead into the target.

Preferably, each actuating finger is integrally formed with its cutting blade and projects laterally outward of the body when such blade is in the retracted position. The combined cutting blade and actuating finger member is pivotally mounted on the body so that, upon entry of the arrowhead into the target, the actuating finger will cause the blade to pivot and move from its retracted position toward its projected position. Thus, as the arrow penetrates deeper into the animal, the cutting blades progressively move to a greater projected position to enlarge the wound and cause more massive hemorrhaging thus leading to quicker death and a significantly higher probability of animal location.

Movement of the blades toward their projected position does not depend on springs or similar stored energy devices Instead such movement is the result of positive engagement of the actuating fingers with the target and the resulting resistance to penetration of such fingers into the target.

The arrow attachment of the invention preferably includes a retaining spring which functions to hold the cutting blades in a safe, stored condition. Such attachment preferably includes tabs formed on the combined cutting blade and actuating finger members which cooperate with the attachment body to control the extent of pivoting of the blades in opposite directions.

THE DRAWINGS

DETAILED DESCRIPTION

Figures 1, 1A, 1B:
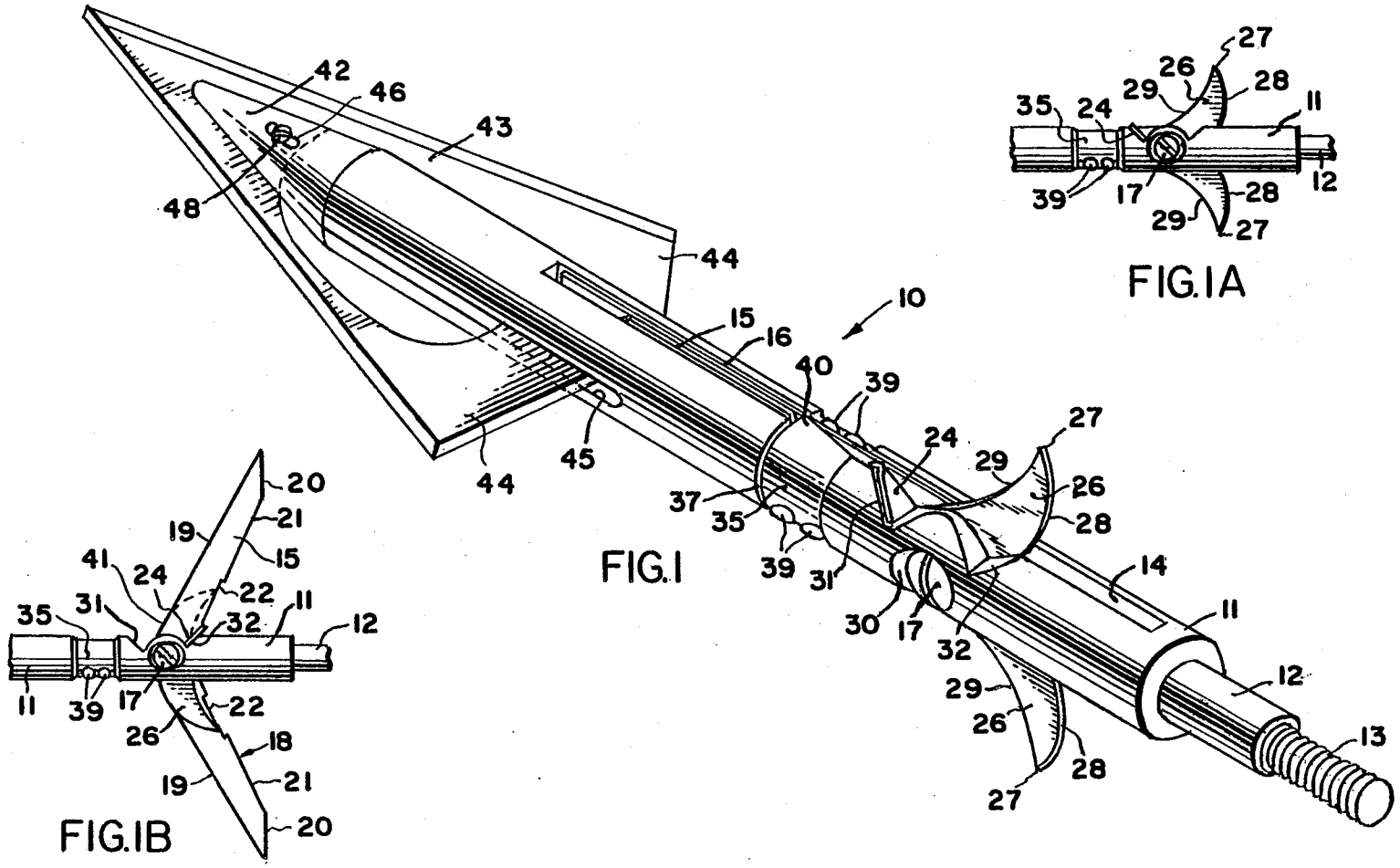
FIG. 1 is an isometric view of an arrow attachment according to one embodiment of the invention.
FIG. 1A is a fragmentary side elevation of the attachment with its cutting blades retracted.
FIG. 1B is a fragmentary side elevation of the attachment with its cutting blades projected.

An arrow attachment constructed according to a preferred embodiment is designated generally by the reference character 10 and includes a cylindrical body 11 having at one end a reduced diameter neck 12 terminating in a threaded stud 13 adapted for removable attachment to a conventional arrow shaft. Although only one form of shaft connection is illustrated, it will be understood that any appropriate form may be utilized and that, if desired, the arrow attachment 10 may form an integral or permanent part of an arrow shaft.

The body 11 is provided centrally and longitudinally thereof with an elongate slot 14 which extends completely through the body 11. A pair of combined cutting blade and actuating finger members 15 and 16 are mounted for movements into and out of the slot about the axis of a pivot screw 17 which extends through the body portion 11 at right angles to the blade and finger members 15 and 16.

Figure 3A:
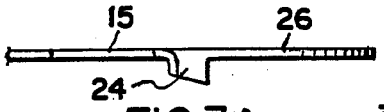
FIG. 3A is a side elevation of the blade and actuating member as viewed along line 3A—3A in FIG. 3.
Figure 3:
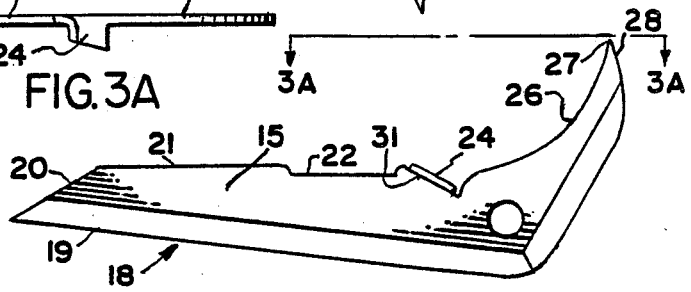
FIG. 3 is a side elevational view of the combined cutting blade and actuating finger member forming a part of the invention.

As is best shown in FIG. 3 each combined blade and finger member 15 and 16 is formed from an integral, flat piece of heat treated steel, which may be 440 stainless or vanadium cutlery steel. Each member includes a cutting blade 18 provided with a razor sharp edge 19 which terminates at one end in a beveled tip 20. That edge of the blade 18 opposite the sharp edge 19 is provided with a flat surface 21, an indented surface 22, and an angled surface 23 which has integrally formed therewith a stop tab 24. The tab 24 is bent at 90° to the angled edge surface 23.

As previously indicated, each combined cutting blade and actuating finger member 15 and 16 is preferably of one-piece construction with an actuating finger 26 formed integrally with the cutting blade 18 and extending at approximately 60° from the adjacent end of the cutting blade 18. Each actuating finger 26 is curvilinear in shape and terminates at its free end in a slightly hooked portion 27. Thus, each finger includes a relatively straight edge 28 and an opposite edge 29 provided with a radius terminating in the hooked end portion 27. As best seen in FIG. 1, the fingers 26 form wing-like extensions of the respective blades.

Figure 2:
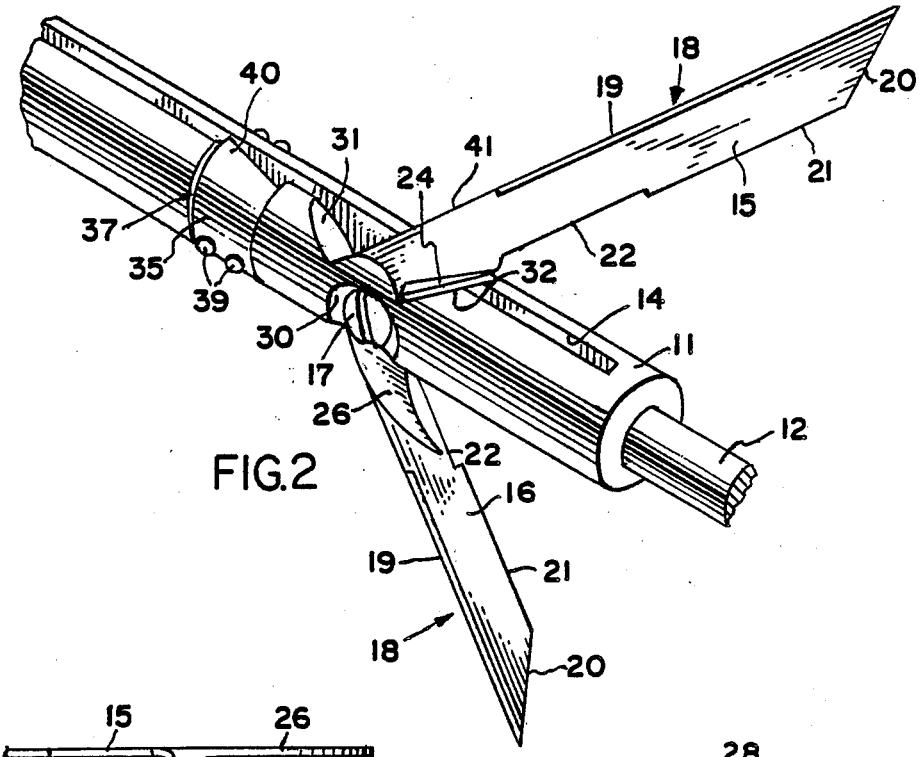
FIG. 2 is a fragmentary, isometric view illustrating the attachment with its cutting blades in projected, operative position.

The body 11 includes a recessed area 30 which receives the pivot screw 17, such screw extending transversely of the slot 14 and pivotally mounting the pair of combined members 15 and 16 in the slot 14 in side-by-side relationship. However, as is best shown in FIG. 2, each combined member 15 and 16 is oppositely facing with respect to the other in the slot 14 so that, when the cutting blades 18 are confined within the slot 14 as illustrated in FIG. 1, the actuating fingers 26 project laterally outward of the slot 14 and beyond the body 11 in diametrically opposed relation with their curved edges 29 facing forwardly of the body 11. The sharp edges 19 of the blades also face forwardly of the body 11 when the blades 18 are projected.

Figure 4:
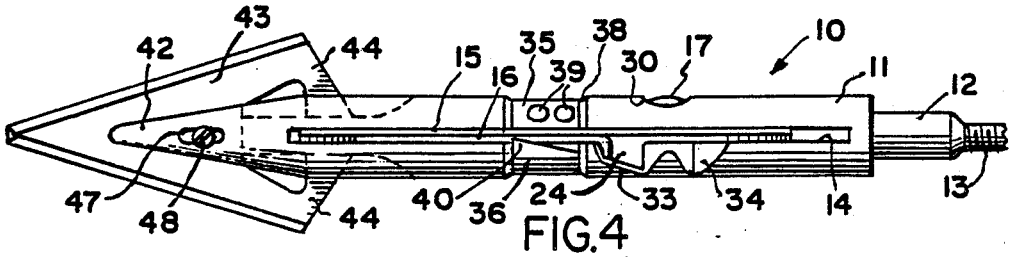
FIG. 4 is a bottom plan view of the attachment of FIGS. 1 and 2.

Adjacent the pivot screw 17 the body 11 is provided with a pair of V-shaped grooves defining a pair of oppositely facing stop surfaces 31 and 32 as illustrated in FIGS. 1 and 2. FIG. 4 illustrates the attachment 10 from the underside thereof and discloses a further pair of V-shaped grooves along the opposite side of the slot 14 to define a second pair of opposed stop surfaces 33 and 34 located approximately 180° from the first pair of surfaces 31 and 32. As is best shown in FIG. 2, the stop surfaces are utilized to engage the stop tabs 24 of each combined member 15 and 16 when the blades 18 are projected. Thus, the stop tab 24 of the combined member 15 engages the stop surface 32 in the exposed condition of the cutting blade 18 of combined member 15. While not specifically illustrated, it will be understood that the stop tab 24 of the combined member 16 will engage the stop surface 34 (FIG. 4) when the cutting blade 18 of the combined member 16 is similarly projected as illustrated in FIG. 2.

FIGS. 1 and 2 illustrate utilization of the stop surfaces. The cutting blades 18 of combined members 15 and 16 are movable from a retracted or stored position as illustrated in FIG. 1 to a final projected position as illustrated in FIG. 2. Since the blades are stored in side-by-side relation in the slot 14, the stop tabs 24 of each blade engages a respective stop surface to prevent each blade from moving in one direction entirely through the slot 14. Thus, in the retracted position shown in FIG. 1, the stop tab 24 of combined member 15 engages the stop surface 31. FIG. 4 illustrates the stop tab 24 of the combined member 16 engaging the stop surface 33. Cooperation between the stop tabs 24 and the cooperating stop surfaces 31–34 results in limiting the extent to which each combined member 15 and 16 may pivot in opposite directions about its pivot axis as defined by the screw 17.

In order to retain the cutting blades 18 safely within the body slot 14, a pair of leaf springs 35 and 36 is provided. Each of these springs is in the form of a clip formed from spring steel and provided with an arcuate shape to conform to the outer configuration of the body 11. Each spring 35 and 36 is mounted within a grooved area 37 and 38, respectively, the grooves being formed in the body 11 on opposite sides of the slot 14.

One edge of each spring 35 and 36 is attached to the body 11 by retainer pins 39. The opposite edge of each spring 35 and 36 is formed at an angle to define a cam surface 40, one end of which projects slightly over the slot 14 by reason of its angled relationship.

FIGS. 1 and 2 illustrate the location of the spring 35 relative to the cutting blade 18 of the combined member 15, and FIG. 4 illustrates the position of the spring 36 and its cam surface 40 relative to the cutting blade 18 of the combined member 16. Thus, when each cutting blade 18 is pivoted toward its retracted condition in the slot 14 a leading edge portion 41 (FIGS. 2 and 3) progressively engages the angled cam surface 40 of the adjacent spring clip to force or cam the spring clip outwardly relative to the body portion 11 to the extent that the cutting blade 18 of each combined member 15 and 16 may move past such edge and be restrained from reverse movement in the opposite direction by the overlapping action of such cam surface. As previously described, cooperation between the stop tabs 24 and the stop surfaces 31 and 33 limit pivotal movement in one direction of the members 15 and 16 through the slot 14. In this manner, each cutting blade 18 may be safely and releaseably confined within the slot 14, whereas the actuating fingers 26 project outwardly of the slot 14 as illustrated in FIG. 1.

Figure 5:
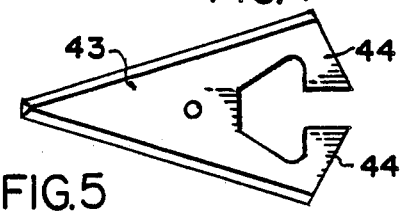
FIG. 5 is a side elevational view of a suitable form of arrowhead useful with the attachment of the invention.

The body 11 may also be provided with an arrowhead mounting arrangement if desired. One form of arrowhead mounting arrangement is illustrated in FIGS. 1, 4, and 5, wherein the forward or leading end of the body 11 is provided with a nose cone 42 which is slotted to receive an arrowhead 43. The base of the arrowhead 43 is provided with a pair of oppositely facing flanges 44 which are slideably received in slots 45 formed in the body 11 inwardly of the nose cone 42. The arrowhead 43 is fitted onto the body 11 with its flanges 44 accommodated in the slots 45 and with the forward body portion of the arrowhead 43 accommodated in the slotted nose cone 42. Such nose cone, as well as the forward body portion of the arrowhead 43, is provided with aligned apertures 46 and 47 through which a retaining screw 48 passes to fix the arrowhead 43 on the body 11. Any other suitable attaching arrangement may be utilized. Obviously, the body 11 may be designed to receive different types of arrowheads.

FIG. 1 illustrates the condition of the arrow attachment 10 in readiness for use, it being understood that such attachment will be connected to the leading end of an arrow shaft (not shown). The wing-like actuating fingers 26 of the members 15 and 16 are exposed or projected with the curved surfaces 29 facing forwardly and the pointed tips 27 directed outwardly and somewhat forwardly. The leading edges of the curved surfaces may be sharp or dull, the latter being preferable. The cutting blades 18 are confined within the body slot 14 by the cooperative functioning of the stop tabs 24, the stop surfaces 31 and 33, and the cam surfaces 40.

When an arrow fitted with the attachment 10 is shot into the animal target, the actuating fingers 26 will be impacted by the target and forced rearwardly about the pivot screw 17 with sufficient force to cause the cutting blades 18 to overcome the restraining action of the springs 35 and 36, thus causing the cutting blades to pivot to a laterally projected position as illustrated in FIG. 2. The springs 35 and 36 are fastened to the body 11 along one edge only thereof to permit such springs to flex outwardly in response to the application of a predetermined adequate force by the cutting blades 18 of the members 15 and 16.

The lateral projection of the blades 18 commence virtually simultaneously upon impact of the actuating fingers 26 with the hide of the animal target. Once the blades are projected outwardly of the slot 14, further penetration of the arrow into the target causes the blades to be projected further, thereby substantially enlarging the wound and increasing hemorrhaging.

The curved actuating fingers 26, including the pointed tips 27, provide a moment arm that substantially assists in the virtually immediate projection of the cutting blades 18. Such cutting blades 18 are not intended to function as barbs. Instead their primary function is to induce substantial hemorrhaging.

When the cutting blades 18 are fully projected the actuating finger 26 of each blade is in overlapping, side-by-side relation with the base areas of cutting blade portion 18. Thus, with the blade actuating fingers 26 lying alongside an adjacent cutting blade 18, such fingers do not in any respect interfere with the cutting function of the blades 18.

Withdrawal of the arrow attachment 10 results in reverse pivoting of the combined members 15 and 16, thereby moving the cutting blades 18 back toward the slot 14 into engagement with retention springs 35 and 36. As this movement progresses, the actuating fingers 26 become progressively exposed and the rear edges 28 are subjected to sufficient withdrawal resistance to move the cutting blades 18 past the projecting cam surfaces 40.

In this manner the cutting blades 18 will virtually automatically be retracted thus minimizing any significant meat tearing, as well as avoiding strong resistance to arrow withdrawal. Highly efficient arrow withdrawal can be accomplished, particularly when the path of withdrawal corresponds substantially to the path of entry. It should also be noted that, by reason of the substantial length of the cutting blades 18 as compared to the reduced length of the actuating fingers 26, the likelihood of such fingers remaining in the path of entry during withdrawal is increased.

In a typical embodiment the total effective cutting blade path may be on the order of approximately three inches. Thus, the weight of the arrow attachment 10 may be kept at a minimum without reducing its effectiveness.

No internal moving parts are utilized in the disclosed embodiment thus increasing its reliability and reducing its cost.

The arrow attachment 10 may be supplied with or without an arrowhead forming a part of it. If such an arrowhead is supplied, the attachment readily lends itself to a simple form of arrowhead installation permitting ready replacement as desired.

Due to the more massive hemorrhaging caused by the arrow attachment, there is a significantly higher probability of visible blood loss for trailing. Additionally, death should occur more quickly and pain diminished substantially. The arrow attachment 10 will function efficiently even if the arrow impacts lighter bones such as ribs.

The attachment may be safely handled as long as the cutting blade portions 18 are stored in the body slot 14. When the blades are stored, the cutting edge 19 of each blade faces inwardly so as to be totally confined within the body 11, the engagement of the stop tabs 24 with the stop surfaces 31 and 33 preventing further pivoting movement of the cutting blade portions 18 through the slot 14 into an unsafe exposed position.

What is claimed is:

1. An arrow attachment comprising a body having an elongate slot extending therethrough; a pair of blades accommodated in said slot in side-by-side relation; each of said blades having a cutting edge; pivot means mounting said blades on said body for rocking movements about an axis between a retracted position within said slot and a projected position in which each of said blades extends laterally outwardly of said slot and on opposite sides of said body; and actuating means carried by each of said blades and extending outwardly of said slot when its associated blade is in said retracted position, each of said actuating means being so located relative to its associated blade as to be operable to rock its associated blade from said retracted position toward said projected position in response to the application of force on such actuating means in one direction, the extent of the rocking movement being such that each of said actuating means may move from a projected position at one side of said body through said slot to a projected position at the opposite side of said body.

2. The arrow attachment of claim 1 wherein said pivot means for each of said blades is between opposite ends thereof.

3. The arrow attachment of claim 1 wherein each of said actuating means is integral with its associated blade.

4. The arrow attachment of claim 1 wherein said actuating means lie alongside and substantially parallel to said blades when said blades are in their projected positions.

5. The arrow attachment of claim 1 wherein a single pivot means mounts said blades in overlying parallel relation in their retracted position.

6. The arrow attachment of claim 1 wherein each of said actuating means is curvilinear and terminates in a hooked end portion facing said one direction when its associated blade is in said retracted position.

7. An arrow attachment for inducing hemorrhaging comprising a body; a pair of cutting blades; a slot in said body accommodating said cutting blades in a retracted position thereof; pivot means mounting said blades in said slot for movement relative to said body from said retracted position to a projected position; actuating means carried by said blades and extending outwardly of said body when said blades are in said retracted position, said actuating means being integrally formed with said blades and operable to move said blades to their projected position in response to the application of force in one direction on said actuating means, each of said blade actuating means being substantially parallel to the other of said blades when said blades are in the projected position; stop means for limiting movement of said integral blades and the blade actuating means relative to said body; and spring means carried by said body for engagement with said cutting blades for releasably holding the latter in said retracted position.

* * * * *

UNITED STATES PATENT AND TRADEMARK OFFICE

CERTIFICATE OF CORRECTION

PATENT NO. : 4,940,246

DATED : July 10, 1990

INVENTOR(S) : Jonathan B. Stagg

It is certified that error appears in the above-identified patent and that said Letters Patent is hereby corrected as shown below:

Column 3, bridging lines 19 and 20, change "relatively straight" to -- curved --.

Column 4, line 25, change "2 and 3" to -- 1B and 2 --.

Signed and Sealed this

Twenty-ninth Day of October, 1991

*Attest:*

HARRY F. MANBECK, JR.

*Attesting Officer*

*Commissioner of Patents and Trademarks*